United States Patent [19]

Ishimaru

[11] Patent Number: 4,820,257

[45] Date of Patent: Apr. 11, 1989

[54] ROTOR NOISE SUPPRESSION

[75] Inventor: Kenzo Ishimaru, San Jose, Calif.

[73] Assignee: Beckman Instruments, Inc., Fullerton, Calif.

[21] Appl. No.: 192,257

[22] Filed: May 10, 1988

[51] Int. Cl.[4] ..... B04B 5/02

[52] U.S. Cl. ..... 494/16

[58] Field of Search ..... 494/16, 17, 20, 21, 494/85, 60; 422/72

[56] References Cited

U.S. PATENT DOCUMENTS

| | | | |
|---|---|---|---|
| 4,301,963 | 11/1981 | Nielsen | 494/16 |
| 4,449,965 | 5/1984 | Strain | 494/16 |
| 4,484,906 | 11/1984 | Strain | 494/16 |
| 4,553,955 | 11/1985 | Lam | 494/16 |

*Primary Examiner*—Robert W. Jenkins

*Attorney, Agent, or Firm*—William H. May; Paul R. Harder

[57] ABSTRACT

An improved centrifuge. The centrifuge may be a conventional centrifuge having a rotor and a plurality of tube receiving adaptors inserted into the rotor in a circular configuration. The improvement comprises a flexible flap having a fixed end mounted on the rotor at an adaptor and having an opposing free end. The free end extends radially inward toward the center of the rotor when the rotor is not rotating and is folded by centrifugal force back to cover the opening in the adaptor when the rotor is rotating. By covering the opening in the adaptor, the flexible flap eliminates the high pitch whistle otherwise generated by the adaptor when rotating without a tube inserted.

10 Claims, 2 Drawing Sheets

ROTOR NOISE SUPPRESSION

This invention relates to centrifuges. In particular, the high pitch whistle caused by an empty rotating adaptor is eliminated by a flexible flap which is mounted on the centrifuge rotor and folded by centrifugal force back over the adaptor during rotation.

BACKGROUND OF THE INVENTION

Centrifuges are used to separate constituent elements using rotational energy.

Centrifuges commonly include a rotor that rotates about its center and a plurality of adaptors that are commonly inserted into the rotor in a circular configuration. Each adaptor has an opening into which a specimen tube may be inserted.

Centrifuges operate at a variety of speeds and in a variety of environments. For example. some centrifuges used in laboratory environments are run at relatively low speeds, i.e., 15,000 rpm, and under atmospheric conditions.

However, when a centrifuge is run under these circumstances, a problem is created unless every adaptor has a tube inserted. In particular, when an empty adaptor is rotated at the above mentioned speed and in the presence of air, an objectionable high pitch whistle is created. This whistle may be very distracting in a laboratory environment where other activities are ongoing. In addition, this whistle has been found to be especially audible and enervating to some workers.

It is possible to eliminate this whistle, for example, by always running the centrifuge with tubes in place or by placing a lid over every empty adaptor in the rotor. However, such approaches are inconvenient and may cause the rotor to be unbalanced.

OBJECTS OF THE INVENTION

It is an object of the invention to provide a simple mechanism for eliminating the high pitch whistle caused by running a centrifuge with an empty adaptor under atmospheric conditions.

It is another object of the invention to eliminate this whistle with minimal inconvenience to a user of the centrifuge.

It is another object of the invention to eliminate this whistle without adding significantly to the cost of the centrifuge and using a means amenable for retrofitting conventional centrifuges.

Still another object of the invention is to eliminate the whistle without unbalancing the rotor.

SUMMARY OF THE INVENTION

According to the invention, an improved low noise centrifuge is provided. The centrifuge may be a conventional centrifuge having a rotor and a plurality of tube receiving adaptors inserted into the rotor in a circular configuration. The improvement comprises a flexible flap having a fixed end mounted on the rotor at an adaptor and having an opposing free end. The free end extends radially inward toward the center of the rotor when the rotor is not rotating and is folded back by centrifugal force over the opening in the adaptor when the adaptor is rotating. By covering the opening, the flexible flap eliminates the high pitch whistle otherwise generated by the adaptor when rotating without a tube inserted.

In one embodiment, the fixed end has a hole through which an adaptor is inserted, permitting the flap to be mounted between the rotor and the adaptor. In another embodiment, a flap assembly having a number of flaps integrated into a one piece assembly is used.

The flap may be made from either an elastomer, or a flexible plastic or any flexible material in various embodiments.

A transparent material may be selected to permit viewing of markings on the adaptors.

The centrifuge may be delivered to the user with a plurality of such flexible flaps premounted on the rotor.

Additional objects and features of the invention will become apparent by reference to the drawings, the description, and the claims appended hereto.

DETAILED DESCRIPTION OF THE DRAWINGS

The invention will now be explained further by reference to FIG. 1 which shows a plurality of flexible flaps mounted on a non-rotating rotor, and by reference to FIG. 2 which shows the flaps folded back over openings in the adaptors when the rotor is rotating to eliminate the high pitch objectionable whistle.

The invention will then be explained by reference to FIG. 3 which depicts the relative relationship of the rotor, flexible flap, adaptor, and a tube when mounted according to one embodiment of the invention. Finally, the invention will be explained by reference to FIGS. 4 and 5 which show flexible flaps according to two embodiments of the invention.

Figure 1:
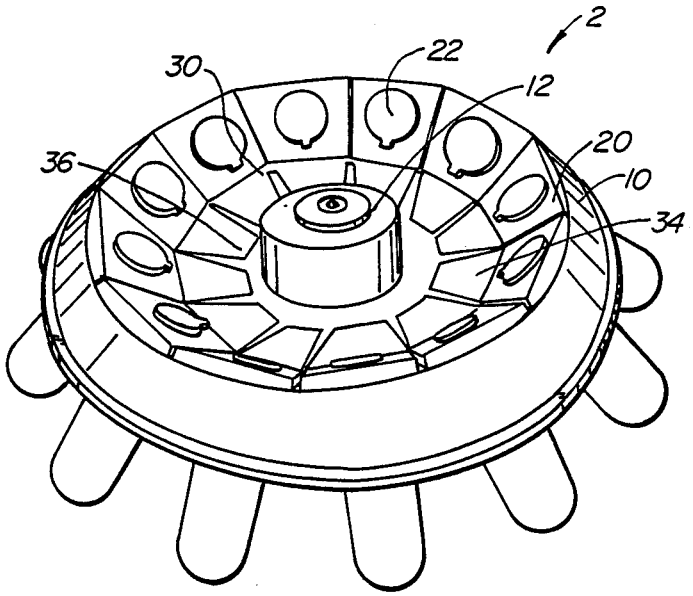
FIG. 1 is a pictorial illustration of a non-rotating rotor having a plurality of flexible flaps mounted thereon according to one embodiment of the invention.

FIG. 1 shows a conventional rotor 10 in a non-rotating state. Rotor 10 is part of a centrifuge (not shown) and has a center 12 about which the rotor rotates during operation of the centrifuge (not shown). Also shown is a plurality of adaptors 20 which are inserted into rotor 10 in a circular configuration. Each adaptor 20 has an opening 22 into which a tube (not shown) may be inserted.

Also shown is a corresponding plurality of flexible flaps 30 mounted on rotor 10, with one flap 30 for each adaptor 20. Each flexible flap 30 has a fixed end 36 and a free end 34.

Each fixed end 34 is attached to an adaptor 20, for example, by extending under adaptor 20 and being mounted between adaptor 20 and the body of rotor 10. Fixed end 34 may be secured by mechanical arrangements, or in some applications, by the centrifugal pressure of adaptor 20 when rotor 10 is rotating.

The free end 34 is disposed opposite to fixed end 36 and extends radially inward toward the center 12 of rotor 10 when rotor 10 is not rotating.

Each flexible flap 30 may be made from an elastomer or flexible plastic material that has sufficient rigidity such that flap 30 extends inward toward center 12 when the rotor is non-operational. Commercially available elastomers such as Neoprene, Buna-N and natural rubber and flexible plastics such as polyvinyl chloride, polyethylene and polypropylene have been found to be suitable materials.

Figure 2:
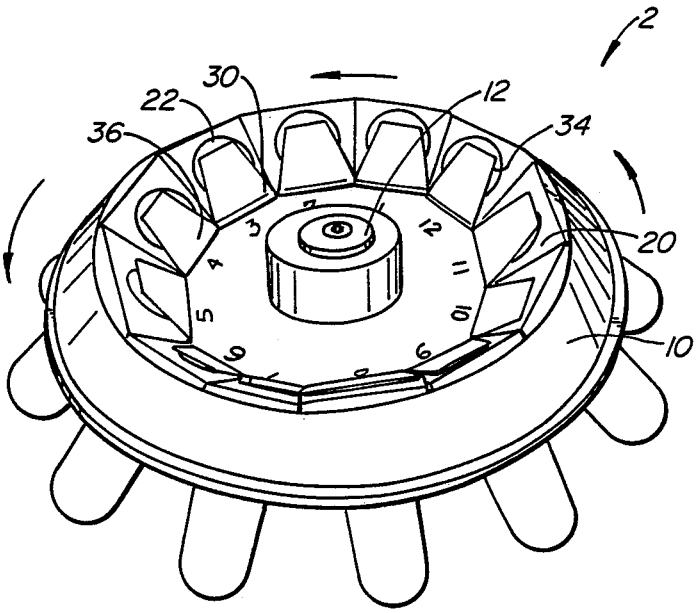
FIG. 2 is a pictorial illustration of a rotating rotor showing the flexible flaps folded back according to the invention.

Refer now to FIG. 2 which shows the arrangement of flexible flaps 30 when rotor 10 is rotating. As shown in FIG. 2, each free end 34 of each flexible flap 30 bends or folds back over an opening 22 in the adaptor 20 to which the flap 30 is attached. The centrifugal force resulting from rotation of rotor 10 are sufficient to cause each flexible flap 30 to bend in the direction of the centrifugal force and thus seal off the opening 22 in the adaptor 20. In the prior art, were no tube inserted in opening 22, a high pitch whistle would be generated when rotor 10 rotates. According to the invention, this objectionable whistle is eliminated when the flap folds back over the opening.

The invention thus provides a simple and inexpensive mechanism for eliminating the high pitch whistle caused by running a centrifuge with an empty adaptor in a vacuumless environment. Since the weight of the flexible flap 30 is negligible, the invention also provides a means for eliminating the objectionable whistle without creating any balancing problems for the rotor. The flap is easily retrofitted onto existing conventional rotors.

Figure 3:
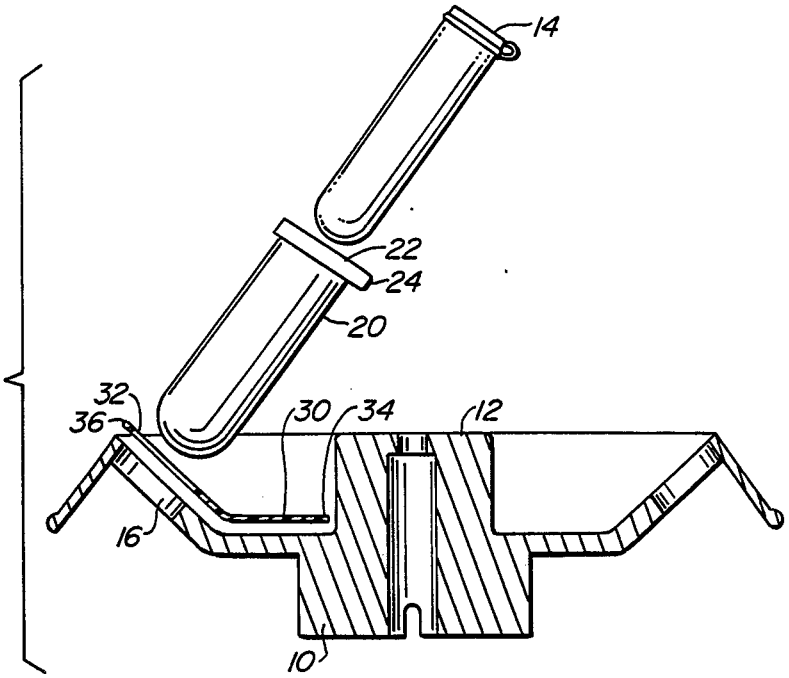
FIG. 3 is a pictorial illustration showing a rotor, a flap, an adaptor, and a tube according to the invention.

Refer now to FIG. 3 which shows the relative placement of a rotor 10, a flexible flap 30, an adaptor 20, and a tube 14 according to one embodiment of the invention. As shown in FIG. 3, a conventional rotor 10 includes an opening 16 into which an adaptor 20 is normally inserted. According to the invention, a flexible flap 30 may be interposed between the adaptor 20 and the rotor 10. As shown in FIG. 3, the flexible flap 30 includes a fixed end 36. Fixed end 36 includes a hole 32. The adaptor 20 is inserted through hole 32 into receiving space 16 in rotor 10. End 36 of flap 30 may be secured in place by a screwing or tightening a cap 24 on adaptor 20.

Thereafter, tube 14 may be inserted into opening 22 in adaptor 20.

Since flap 30 extends inward toward the center of the rotor 10, it is out of the way if tube 14 is inserted into adaptor 20. Since flap 30 returns to its radially extended position when the rotor 10 stops rotating, tube 14 can also be removed from adaptor 20 unhindered by flap 30.

Figure 4:
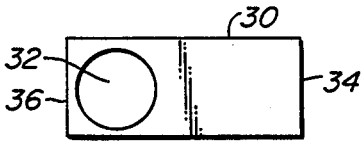
FIGS. 4 and 5 are flexible flaps according to the invention.

Refer now to FIG. 4 which shows a very simple embodiment of a flexible flap 30 which may be used for the arrangement discussed in FIG. 3. Flexible flap 30 is rectangular in shape and has an end 36 (i.e., the fixed end) which includes a hole 32. Flap 30 has an opposing, free end 34.

Figure 5:
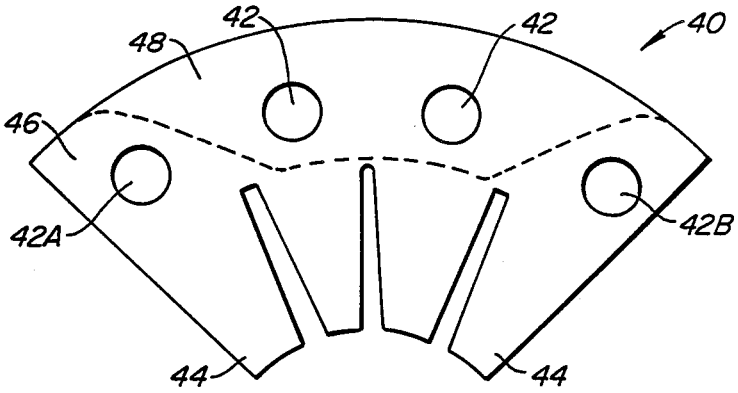

Refer now to FIG. 5 which shows a flap assembly according to another embodiment of the invention. The flap assembly 40 includes a flap base 46 and a plurality of opposing free ends 44. The flap base 46 includes holes 42, 42A, and 42B, through which a plurality of adaptors (not shown) may be inserted. The flap assembly 40 is one piece and the flap base 46 diverges into a plurality of free ends 44, one free end for each opening in the corresponding plurality of adaptors.

Flap assembly 40 is fabricated as a single piece and is thereby handled and mounted on the rotor with increased convenience for a user. For additional convenience, flap base 46 may include an indentation 48, defined by the dashed lines in FIG. 5, to minimize the number of attachments and insertions used between flap assembly 40 and the rotor and/or the adaptors.

Although the invention has been described with respect to the foregoing drawings and embodiments, it should be understood that other modifications may be made within the scope and spirit of the invention. For example, each flexible flap may be wider at the fixed end than at the free end to compensate for the decreased dimensions of the rotor near its center. According to this embodiment, the flexible flap could have a substantially triangular shape.

It is also within the scope of the invention to fabricate a plurality of flexible flaps as a single piece to facilitate ease of mounting on the rotor. It is expected that four such flexible flaps or a complete, circular flap assembly would give good results. In addition, when a plurality of flexible flaps are fabricated as a single piece, it is within the scope of the invention that the flap assembly not necessarily be attached to each adaptor. Rather, the flap assembly may be attached, for example, at the two outer holes 42A and 42B of the flap assembly shown in FIG. 5.

Thus, the invention is to be limited only in accordance with the appended claims.

What is claimed is:

1. In a centrifuge of the type including a rotor having a center about which said rotor rotates: and a plurality of adaptors, each inserted into said rotor and having an opening into which a tube may be inserted:

the improvement comprising:

a flexible flap having a fixed end mounted on said rotor at an adaptor and having a free end, said free end opposite to said fixed end and extending radially inward toward said center of said rotor when said rotor is not rotating, said free end folded by centrifugal force back over the opening in said adaptor when said rotor is rotating, whereby the audible noise made when said rotor is rotating without a tube inserted in said opening is substantially eliminated.

2. The invention of claim 1 and wherein said flap is mounted between said rotor and said adaptor.

3. The invention of claim 1 and wherein said flap is substantially transparent.

4. The invention of claim 1 and wherein said fixed end has a hole through which an adaptor is inserted.

5. The flap of claim 1 and wherein said flap is selected from a group consisting of an elastomer or a flexible plastic, elastomer, flexible plastic.

6. The flap of claim 1 and wherein said flap has a width that narrows from said fixed end to said free end.

7. In a centrifuge of the type including:

a rotor having a center about which said rotor rotates: and a plurality of adaptors inserted into said rotor in a circle about said center, each said adaptor having an opening into which a tube may be inserted, the improvement comprising:

a flexible flap assembly mounted on said rotor, said flexible flap assembly including:

a flap base attached to said rotor at a plurality of adaptors; and a plurality of free ends, each said free end opposite to said flap base and extending radially inward toward said center when said rotor is not rotating, said free ends folded by centrifugal force back over the openings in a plurality of adaptors when said rotor is rotating, whereby the audible noise made when said rotor is rotating without a tube inserted in either of said openings is substantially eliminated.

8. The invention of claim 7 and wherein said flap base includes at least one hole through which an adaptor is inserted.

9. The invention of claim 7 and wherein said flexible flap assembly includes at least four contiguous free ends.

10. A centrifuge comprising:

a rotor having a center about which said rotor rotates;

a plurality of adaptors inserted into said rotor in a circle about said center, each said adaptor having an opening into which a tube may be inserted; and a flexible flap having a fixed end mounted on said rotor at an adaptor and having a free end, said free end opposite to said fixed end and extending radially inward toward said center when said rotor is not rotating, said free end folded by centrifugal force back over the opening in said adaptor when said rotor is rotating, whereby the audible noise made when said rotor is rotating without a tube inserted in said opening is substantially eliminated.

* * * * *